US012716638B2

(12) United States Patent
Schroeder et al.

(10) Patent No.: US 12,716,638 B2
(45) Date of Patent: Aug. 25, 2026

(54) REFRIGERATOR APPLIANCE INCLUDING A FRESH FOOD CHAMBER COLD WALL

(71) Applicant: Haier US Appliance Solutions, Inc., Wilmington, DE (US)

(72) Inventors: Michael Goodman Schroeder, Crestwood, KY (US); Brent Alden Junge, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 221 days.

(21) Appl. No.: 18/409,238

(22) Filed: Jan. 10, 2024

(65) Prior Publication Data

US 2025/0224170 A1 Jul. 10, 2025

(51) Int. Cl.

| | |
|---|---|
| ***F25D 17/06*** | (2006.01) |
| ***F25D 21/14*** | (2006.01) |
| ***F25D 23/06*** | (2006.01) |

(52) U.S. Cl.

CPC ..... *F25D 17/065* (2013.01); *F25D 21/14* (2013.01); *F25D 23/066* (2013.01); *F25D 2317/061* (2013.01)

(58) Field of Classification Search

CPC ..... F25D 17/065; F25D 21/14; F25D 23/066; F25D 2317/061; F25D 27/00

See application file for complete search history.

(56) References Cited

U.S. PATENT DOCUMENTS

| | | | | |
|---|---|---|---|---|
| 3,375,677 | A * | 4/1968 | Bright | F25D 17/065 62/89 |
| 2010/0257877 | A1* | 10/2010 | Yun | F25D 17/065 62/340 |
| 2012/0023997 | A1 | 2/2012 | Jung et al. | |
| 2021/0148627 | A1* | 5/2021 | Jeong | F25D 17/08 |
| 2021/0325106 | A1* | 10/2021 | Marinello | F25D 23/085 |
| 2023/0288126 | A1* | 9/2023 | Miao | F25D 23/066 |

FOREIGN PATENT DOCUMENTS

| | | |
|---|---|---|
| CN | 101529175 B | 7/2011 |
| KR | 100776422 B1 | 11/2007 |

* cited by examiner

*Primary Examiner* — Elizabeth J Martin
(74) *Attorney, Agent, or Firm* — Dority & Manning, P.A.

(57) ABSTRACT

A refrigerator appliance includes a cabinet; a liner attached to the cabinet and defining a fresh food chamber and a freezer chamber; wherein a receiving space is formed between the cabinet and the liner; an icemaker at least partially received within the fresh food chamber; a cooling system including an air supply duct positioned within the receiving space; an air return duct positioned within the receiving space; and a fan configured to motivate air through the air supply duct and the air return duct, wherein the air return duct is in planar contact with an outer surface of the liner along the fresh food chamber; and a panel positioned within the fresh food chamber and adjacent to the liner opposite the air supply duct and the air return duct, wherein a gap is formed between the liner and the panel.

20 Claims, 10 Drawing Sheets

REFRIGERATOR APPLIANCE INCLUDING A FRESH FOOD CHAMBER COLD WALL

FIELD OF THE INVENTION

The present subject matter relates generally to home appliances, and more particularly to refrigerator appliances.

BACKGROUND OF THE INVENTION

Certain appliances, such as refrigerator appliances, generally include an icemaker. In order to produce ice, liquid water is directed to the icemaker and frozen. After being frozen, ice may be stored within a storage bin appliance. In order to ensure ice is formed and/or remains in a frozen state, the icemaker and bin may be mounted within a chilled portion of the appliance. For instance, some conventional appliances provide an icemaker and storage bin within a freezer compartment. Other conventional appliances provide the icemaker and storage bin within a separate sub-compartment, e.g., within a door. In order to maintain efficient operation of the appliance, these conventional appliances generally provide an air circulation system to continuously circulate air within the sub-compartment with air within the freezer compartment.

Certain drawbacks exist with these conventional appliances. For instance, supply ducts should be heavily insulated to prevent heat loss through the system. The increased insulation reduces the overall storage size of the refrigerator. Moreover, in some conventional systems (e.g., appliances having a separate sub-compartment for the icemaker and/or storage bin), circulating air may generate an undesirable temperature gradient within the freezer or the fresh food chamber. In some instances, this may lead to some items within the freezer chamber or the fresh food chamber reaching an undesirable temperature. Although separate evaporators or cooling components may be provided to reduce the temperature gradient (i.e., the effects of relatively warm sub-compartment air), such components may generally increase the complexity and overall inefficiency of the appliance. Moreover, such components may be difficult to effectively and consistently control.

Accordingly, a refrigerator appliance which obviates one or more of the above-mentioned drawbacks would be beneficial. In particular, a refrigerator appliance having a cooling system to provide cooling to the fresh food chamber while supplying cold air to the icemaker would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet; a liner attached to the cabinet and defining a fresh food chamber and a freezer chamber; wherein a receiving space is formed between the cabinet and the liner; an icemaker at least partially received within the fresh food chamber; a cooling system including an air supply duct in fluid communication with the icemaker and positioned within the receiving space, an air return duct in fluid communication with the icemaker and positioned within the receiving space, and a fan configured to motivate air through the air supply duct and the air return duct, wherein the air return duct is in planar contact with an outer surface of the liner along the fresh food chamber; and a panel positioned within the fresh food chamber and adjacent to the liner opposite the air supply duct and the air return duct, wherein a gap is formed between the liner and the panel.

In another exemplary aspect of the present disclosure, a refrigerator appliance is provided. The refrigerator appliance may include a cabinet; a liner attached to the cabinet and defining a fresh food chamber and a freezer chamber; wherein a receiving space is formed between the cabinet and the liner; an icemaker at least partially received within the fresh food chamber; a cooling system including an air supply duct in fluid communication with the icemaker and positioned within the receiving space along a first lateral side of the fresh food chamber, an air return duct in fluid communication with the icemaker and positioned within the receiving space along the first lateral side of the fresh food chamber, an evaporator positioned at the freezer chamber, and a fan configured to motivate air from the evaporator through the air supply duct and the air return duct, wherein the air return duct is in planar contact with an outer surface of the liner along the first lateral side of the fresh food chamber; and a panel positioned within the fresh food chamber and adjacent to the liner opposite the air supply duct and the air return duct, wherein a gap is formed between the liner and the panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
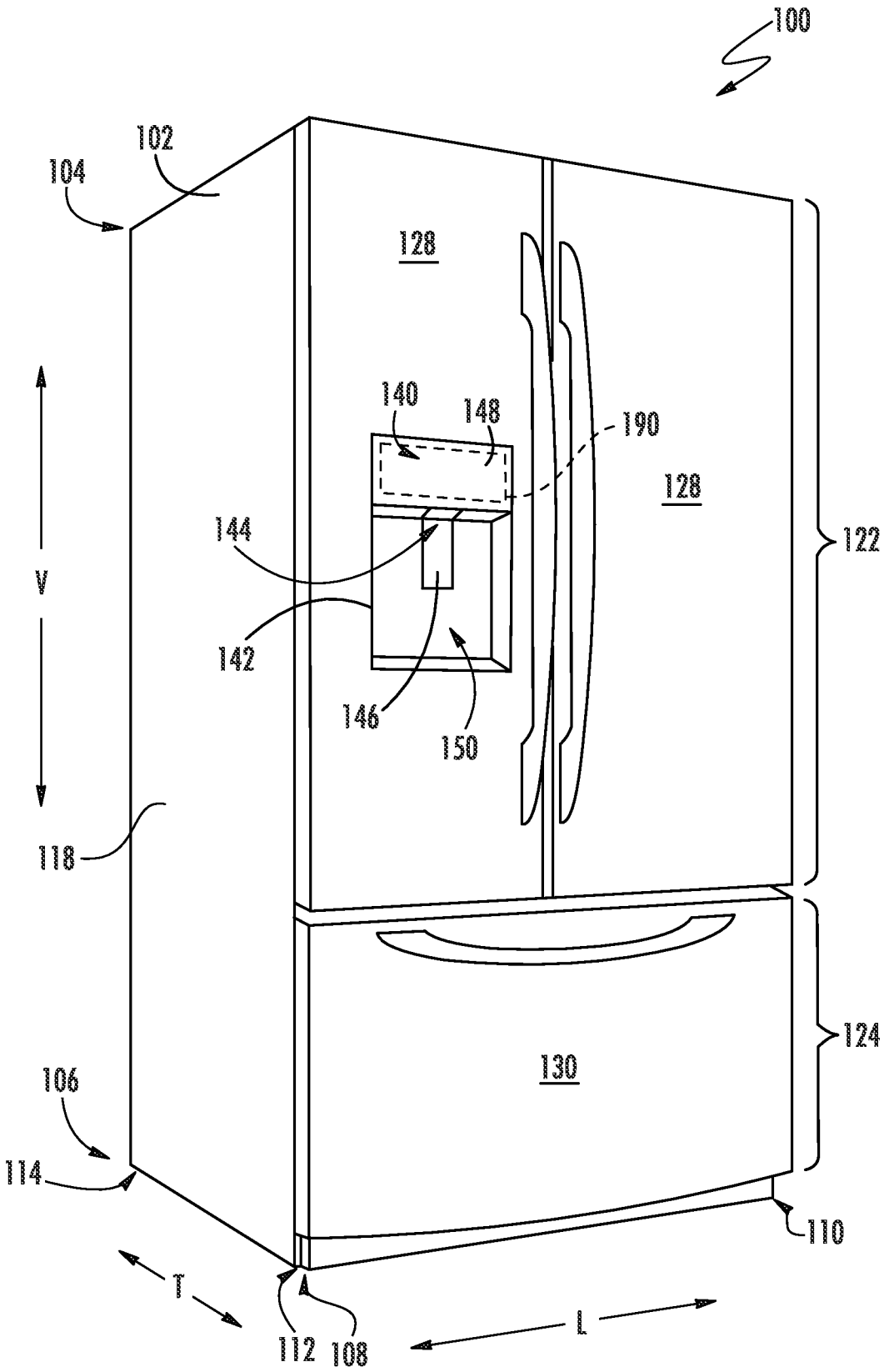
FIG. 1 provides a perspective view of a refrigerator appliance according to example embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, a refrigerator appliance may be provided in some aspects of the present disclosure. The refrigerator appliance can include multiple separate chambers, such as a fresh food chamber and a freezer chamber. An icebox compartment for an icemaker can also be included. For instance, an icebox compartment can be defined in a door that permits access to the fresh food chamber. A separate convection compartment can also be included to exchange chilled air with the icebox compartment. The convection compartment can be formed along a wall of freezer chamber, while still being sealed off from the rest of the freezer chamber. During use, air can be circulated between the convection compartment and the icebox compartment.

Figure 2:
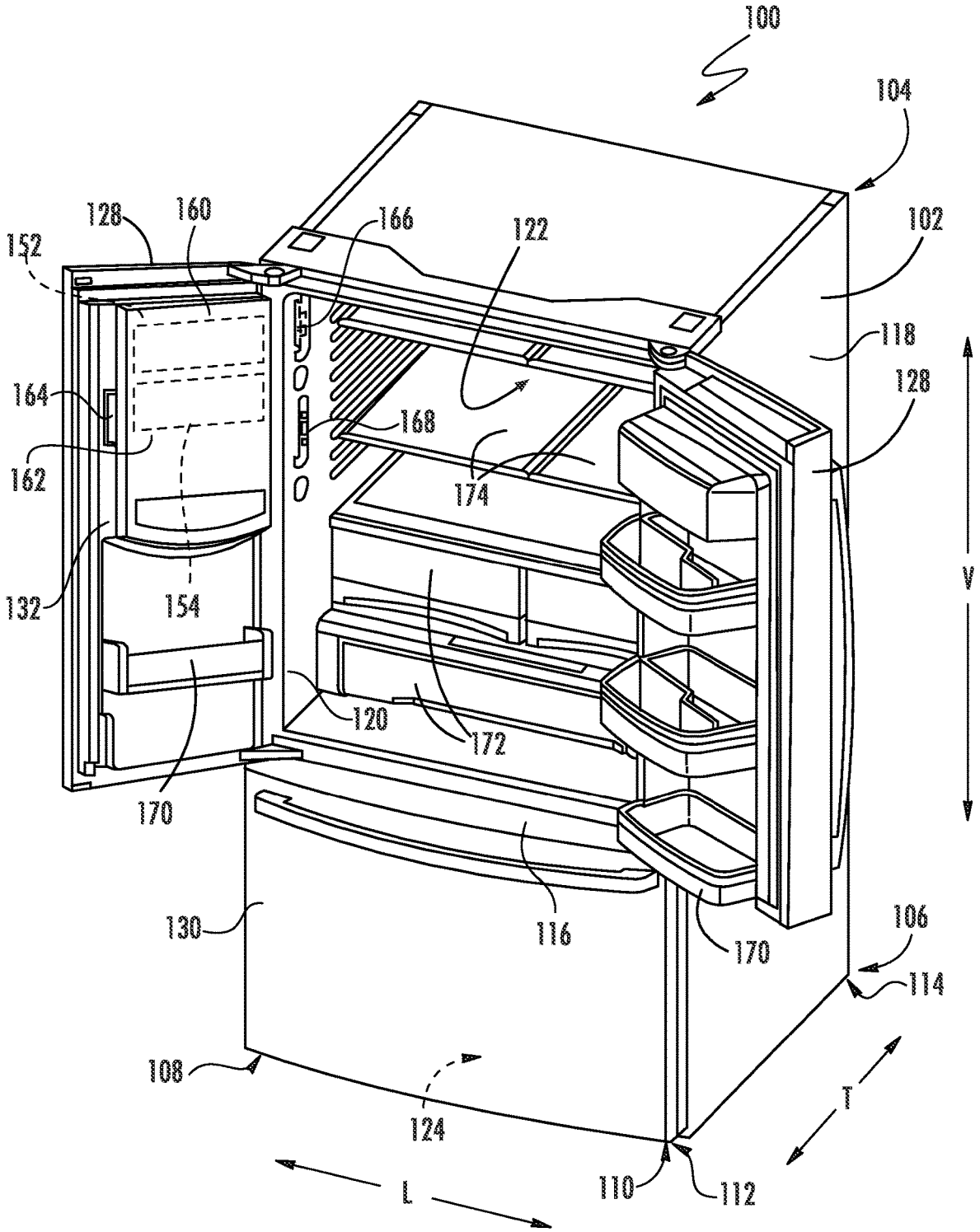
FIG. 2 provides a perspective view of the example refrigerator appliance shown in FIG. 1, wherein a refrigerator door is in an open position according to an example embodiments of the present disclosure.

Turning to the figures, FIGS. 1 and 2 illustrate perspective views of an example appliance (e.g., a refrigerator appliance 100) that includes an ice making feature. Refrigerator appliance 100 includes a housing or cabinet 102 having an outer liner 118. As shown, cabinet generally extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another and form an orthogonal direction system.

As shown, cabinet 102 may generally define chilled chambers for receipt of food items for storage. In particular, cabinet 102 defines a fresh food chamber 122 proximal to adjacent top 104 of cabinet 102 and a freezer chamber 124 arranged proximal to bottom 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

According to the illustrated embodiment, various storage components are mounted within fresh food chamber 122 to facilitate storage of food items therein as will be understood by those skilled in the art. In particular, the storage components may include bins 170, drawers 172, and shelves 174 that are mounted within fresh food chamber 122. Bins 170, drawers 172, and shelves 174 may be positioned to receive food items (e.g., beverages and/or solid food items) and may assist with organizing such food items. As an example, drawers 172 can receive fresh food items (e.g., vegetables, fruits, and/or cheeses) and increase the useful life of such fresh food items. In some embodiments, a lateral mullion 116 is positioned within cabinet 102 and separating freezer chamber 124 and the fresh food chamber 122 along a vertical direction V.

Refrigerator doors 128 may be rotatably hinged to an edge of cabinet 102 for selectively accessing fresh food chamber 122 and extending across at least a portion of fresh food chamber 122. In addition, a freezer door 130 may be arranged below refrigerator doors 128 for selectively accessing freezer chamber 124 and extending across at least a portion of freezer chamber 124. Freezer door 130 may be coupled to a freezer drawer (not shown) slidably mounted within freezer chamber 124. Refrigerator doors 128 and freezer door 130 are each shown in the closed position in FIG. 1 (i.e., a first closed position corresponding to doors 128, and a second closed position corresponding to door 130).

Refrigerator appliance 100 may also include a delivery assembly 140 for delivering or dispensing liquid water and/or ice. Delivery assembly 140 may include a dispenser 142 positioned on or mounted to an exterior portion of refrigerator appliance 100, e.g., on one of refrigerator doors 128. Dispenser 142 may include a discharging outlet 144 for accessing ice and liquid water. An actuating mechanism 146, shown as a paddle, may be mounted below discharging outlet 144 for operating dispenser 142. In additional or alternative example embodiments, any suitable actuating mechanism may be used to operate dispenser 142. For example, dispenser 142 can include a sensor (such as an ultrasonic sensor) or a button rather than the paddle. A user interface panel 148 may be provided for directing (e.g., selecting) the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In example embodiments, dispenser recess 150 is positioned at a level that approximates the chest level of a user. During certain operations, the dispensing assembly 140 may receive ice from an icemaker 152 mounted in a sub-compartment of the fresh food chamber 122, as described below.

Operation of the refrigerator appliance 100 can be generally controlled or regulated by a controller 190. In some embodiments, controller 190 is operably coupled to user interface panel 148 and/or various other components, as will be described below. User interface panel 148 provides selections for user manipulation of the operation of refrigerator appliance 100. As an example, user interface panel 148 may provide for selections between whole or crushed ice, chilled water, and/or specific modes of operation. In response to one or more input signals (e.g., from user manipulation of user interface panel 148 and/or one or more sensor signals), controller 190 may operate various components of the refrigerator appliance 100 according to the current mode of operation.

Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. For certain embodiments, the instructions include a software package configured to operate appliance 100 and, e.g., execute an operation routine including the example method 600 described below with reference to FIG. 17. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 190, or portions thereof, may be positioned in a variety of locations throughout refrigerator appliance 100. In example embodiments, controller 190 is located within the user interface panel 148. In other embodiments, the controller 190 may be positioned at any suitable location within refrigerator appliance 100, such as for example within the fresh food chamber 122, a freezer door 130, etc. Input/output ("I/O") signals may be routed between controller 190 and various operational components of refrigerator appliance 100. For example, user interface panel 148 may be operably coupled to controller 190 via one or more signal lines or shared communication busses.

Figure 6:
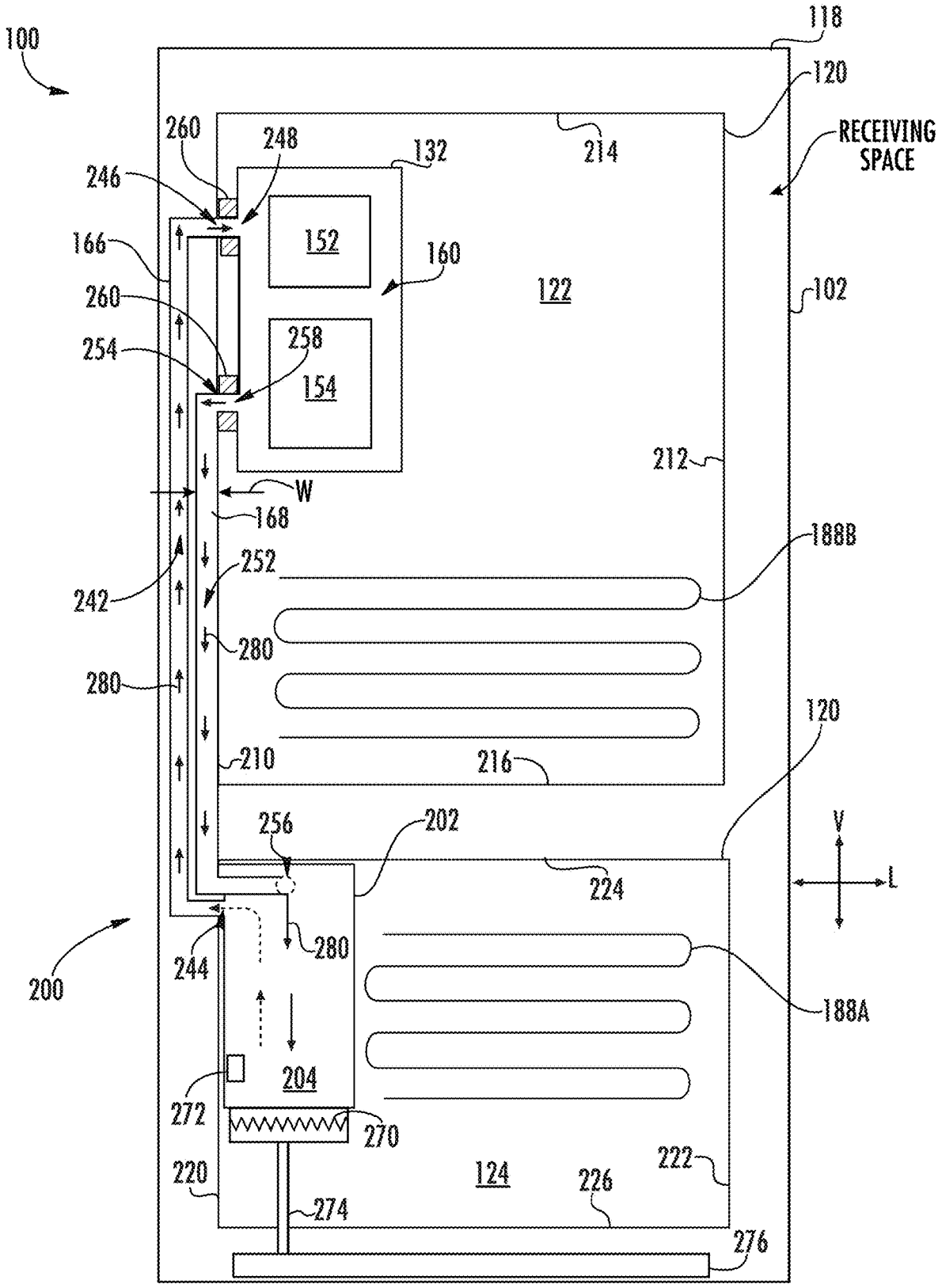
FIG. 6 provides a schematic front view of a refrigerator appliance according to the example embodiments of FIG. 3.

As illustrated, controller 190 may be operably coupled to the various components of dispensing assembly 140 and may control operation of the various components, such as a defrost heater 270 (FIG. 6). For example, the various valves, switches, etc. may be actuatable based on commands from the controller 190. As discussed, interface panel 148 may additionally be operably coupled to the controller 190. Thus, the various operations may occur based on user input or automatically through controller 190 instruction.

FIG. 2 provides a perspective view of refrigerator appliance 100 shown with refrigerator doors 128 in the open position. As shown, an icebox liner 132 defining a sub-compartment (e.g., icebox compartment 160) is attached to cabinet 102. For instance, in some embodiments, at least one door 128 includes icebox liner 132 positioned thereon. In turn, icebox compartment 160 is defined within one of doors 128. In some such embodiments, icebox compartment 160 extends into fresh food chamber 122 when refrigerator door 128 is in the closed position. Although icebox compartment 160 is shown in door 128, additional or alterative embodiments may include an icebox compartment defined at another portion of refrigerator appliance 100 (e.g., within door 130 or fresh food chamber 122). An ice making assembly or icemaker 152 may be positioned or mounted within icebox compartment 160. Ice may be supplied to dispenser recess 150 (FIG. 1) from the icemaker 152 in icebox compartment 160 on a back side of refrigerator door 128.

An access door—e.g., icebox door 162—may be hinged to icebox compartment 160 to selectively cover or permit access to opening of icebox compartment 160. When refrigerator door 128 and icebox door 162 are both closed, icebox door 162 thus seals icebox compartment 160 from fresh food chamber 122. Any manner of suitable latch 164 is provided with icebox compartment 160 to maintain icebox door 162 in a closed position. As an example, latch 164 may be actuated by a consumer in order to open icebox door 162 for providing access into icebox compartment 160. Icebox door 162 can also assist with insulating icebox compartment 160, e.g., by thermally isolating or insulating icebox compartment 160 from fresh food chamber 122. Icebox compartment 160 may receive cooling air from a chilled air supply duct 166 and a chilled air return duct 168 positioned on a side portion of cabinet 102 of refrigerator appliance 100

(e.g., at least partially enclosed between outer liner or casing 118 and internal liner 120). In this manner, the supply duct 166 and return duct 168 may recirculate chilled air from a suitable heat exchange case 202 through icebox compartment 160. An air handler 176 (FIG. 4), such as a fan or blower, may be provided to motivate and recirculate air. As an example, air handler 176 can direct chilled air from a separate compartment through a duct to compartment 160, as will be described below.

In some embodiments, one or more of an icemaker 152 and ice bucket or storage bin 154 are provided within icebox compartment 160. Icemaker 152 may be any suitable assembly for generating ice from liquid water, such as a rigid cube, soft-ice, or nugget ice making assembly. Ice storage bin 154 may be positioned to receive and/or store ice from icemaker 152. Optionally, ice storage bin 154 is positioned below icemaker 152 and receives therefrom. For instance, an ice chute (not pictured) may be positioned adjacent to icemaker 152 to direct ice from icemaker 152 to ice bin 154. From ice storage bin 154, the ice can enter delivery assembly 140 and be accessed by a user.

Figure 3:
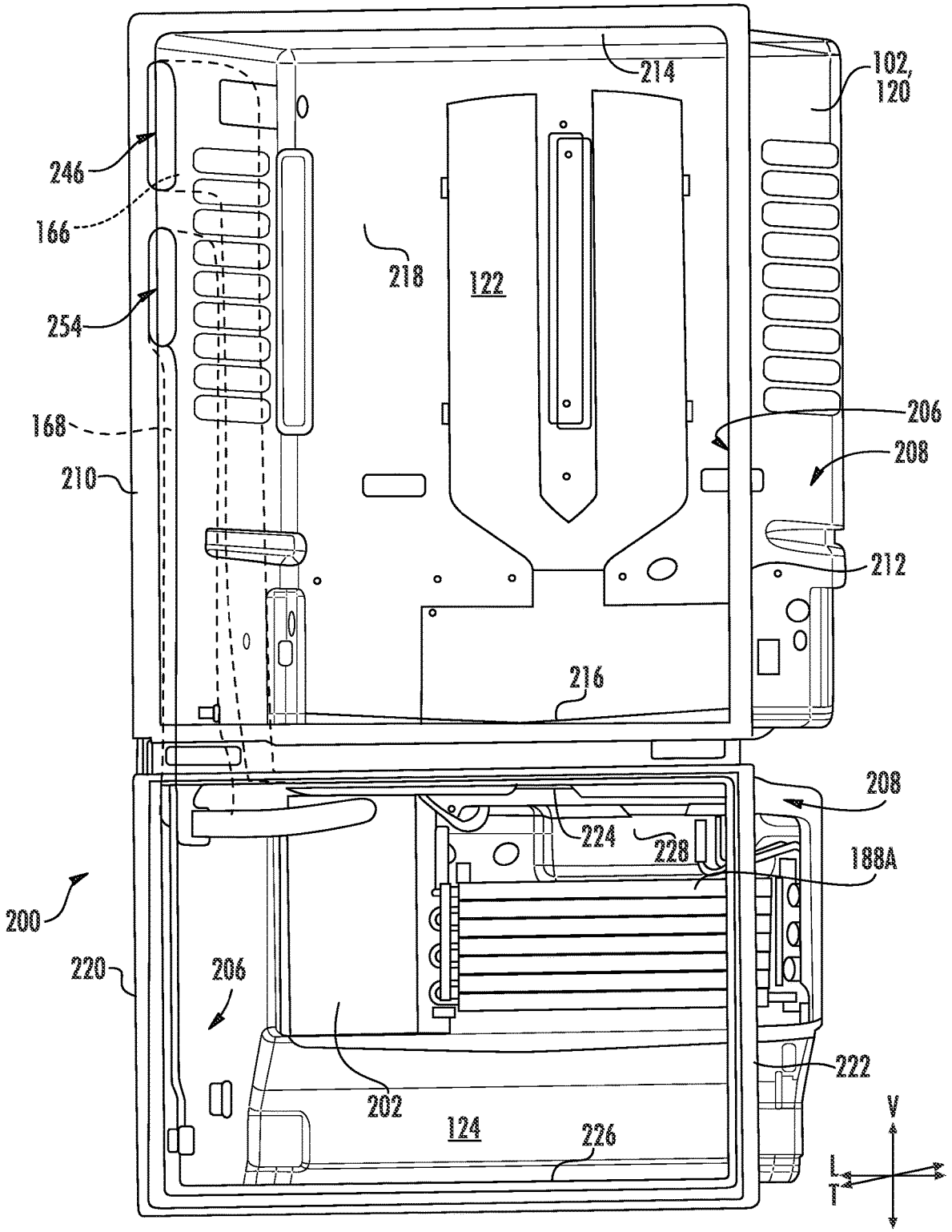
FIG. 3 provides a perspective view of an internal liner and air circulation system of a refrigerator appliance according to example embodiments of the present disclosure.
Figure 4:
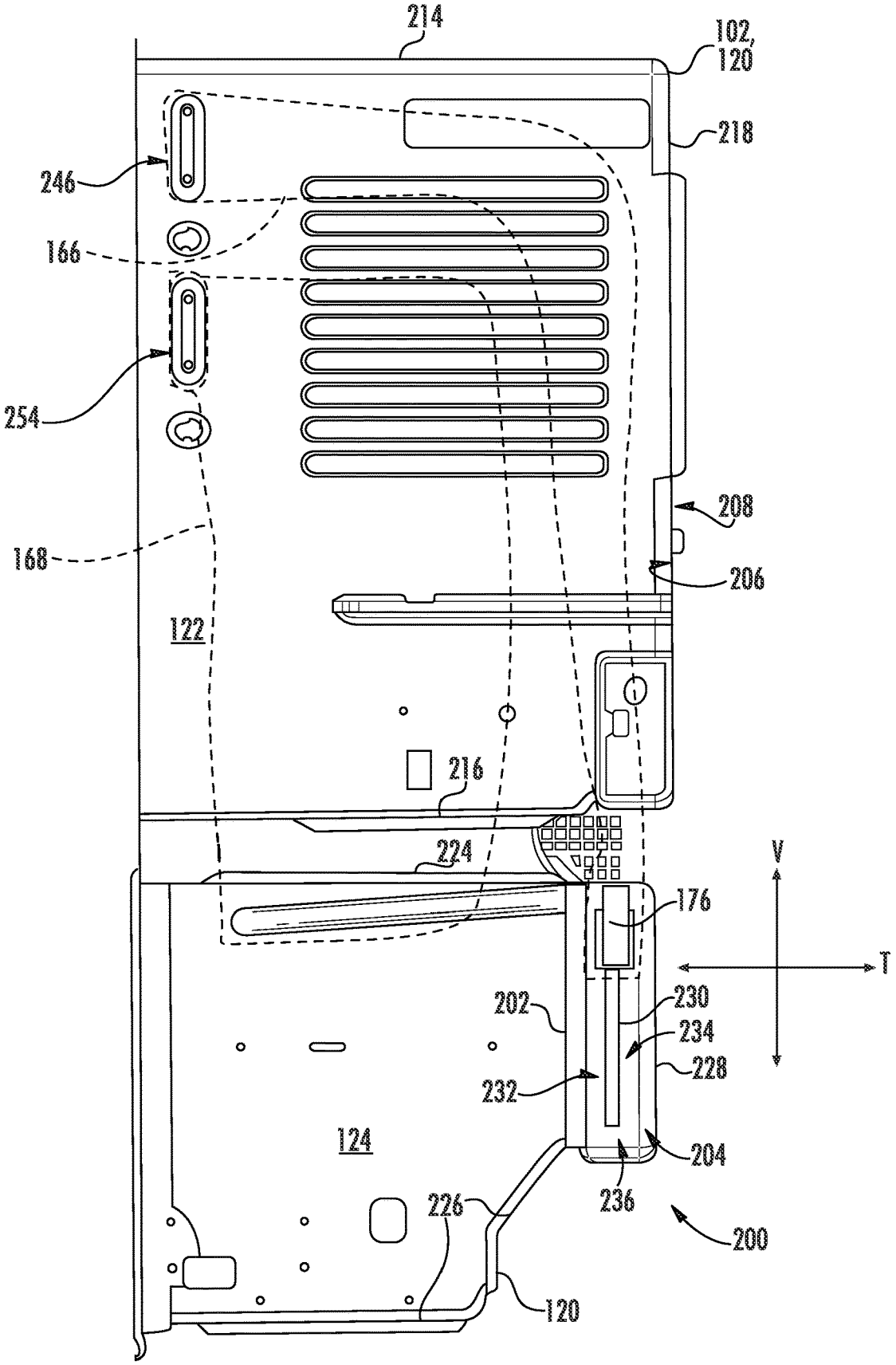
FIG. 4 provides a side view of the internal liner and air circulation system of the example embodiments of FIG. 3.
Figure 5:
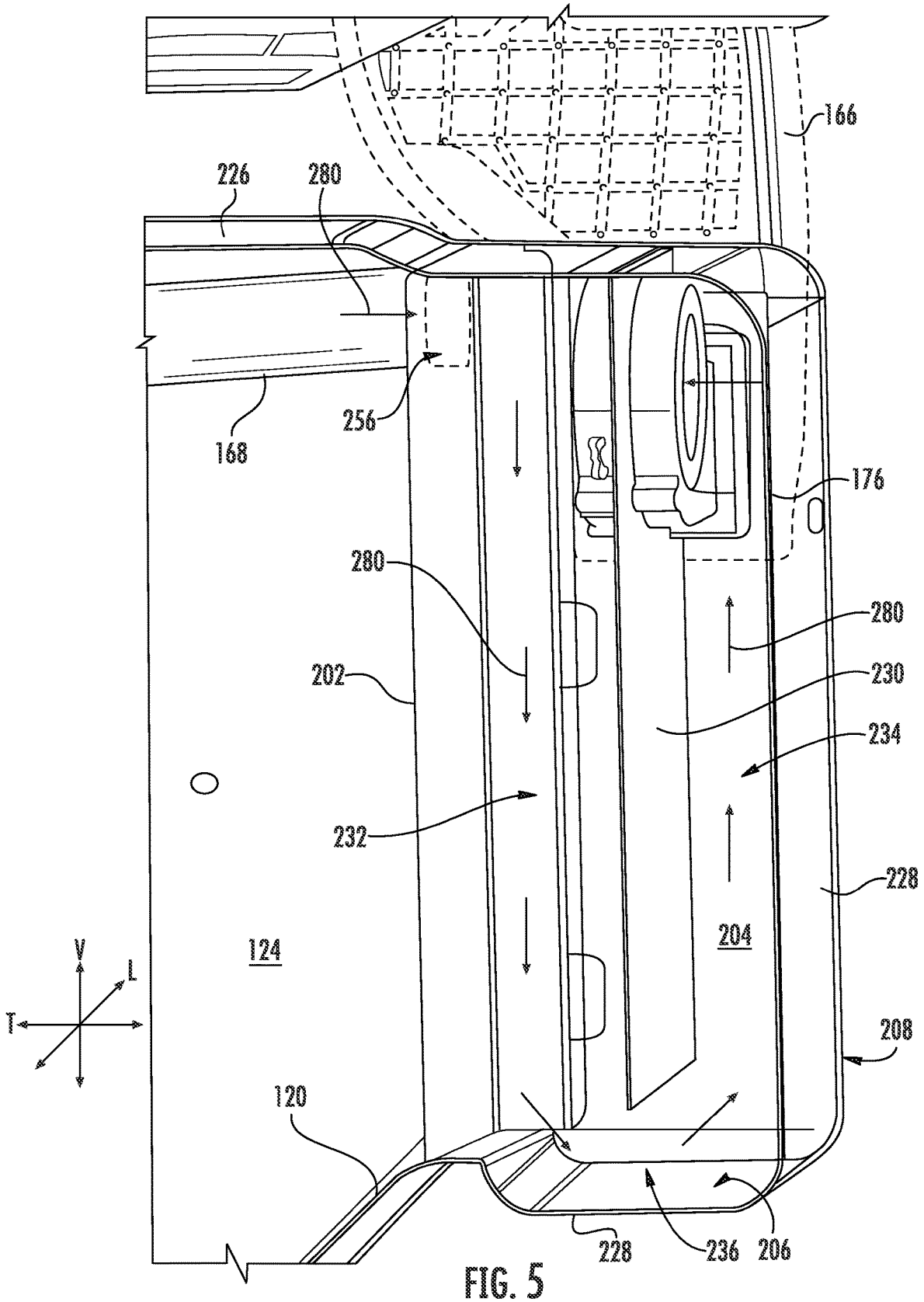
FIG. 5 provides a magnified rear perspective view of a heat exchange case of the example embodiments of FIG. 3.

Turning now to FIGS. 3 through 6, various views of components of refrigerator appliance 100, including an air circulation system 200, are provided. FIGS. 3 and 4 provide a perspective and a side view, respectively, of an internal liner 120 of refrigerator appliance 100. FIG. 5 provides a magnified rear perspective view of a heat exchange case 202 and a defined convection compartment 204. FIG. 6 provides a schematic front view of refrigerator appliance 100, and further illustrates air circulation system 200.

As shown, internal liner 120 generally defines fresh food chamber 122 and/or freezer chamber 124. Specifically, an inner surface 206 of internal liner 120 may define one or both of fresh food chamber 122 and freezer chamber 124. An opposite outer surface 208 of internal liner 120 may face away from inner surface 206 and the respective fresh food chamber 122 or freezer chamber 124.

Internal liner 120 may be formed from a single continuous integral component or, alternatively, from multiple connected pieces. When assembled, fresh food chamber 122 may be fluidly isolated from freezer chamber 124. For instance, both chamber 122, 124 may be isolated such that no air is exchanged between chambers 122, 124 when one or both of doors 128, 130 are closed.

In the illustrated embodiments, internal liner 120 includes a plurality of walls defining chambers 122, 124. Specifically, internal liner 120 includes a first and a second fresh food sidewall (210 and 212) spaced apart along the lateral direction L, as well as an upper and a lower fresh food wall (214 and 216) spaced apart along the vertical direction V. A rear fresh food wall 218 may join upper fresh food wall 214, lower fresh food wall 216, and fresh food sidewalls 210, 212 to define an internal extreme of fresh food chamber 122 along the transverse direction T (i.e., a point or plane of fresh food chamber 122 most proximal to rear side 114 of cabinet 102). Rear fresh food wall 218 may further be positioned opposite an opening defined between the transverse fresh food walls 210, 212, 214, 216 and selectively covered by doors 128. Internal liner 120 may further include a first and a second freezer sidewall (220 and 222) spaced apart along the lateral direction L, as well as an upper and a lower freezer wall (224 and 226) spaced apart along the vertical direction V. A rear freezer wall 228 may join upper freezer wall 224, lower freezer wall 226, and freezer sidewalls 220, 222 to define an internal extreme of freezer chamber 124 along the transverse direction T (i.e., a point or plane of freezer chamber 124 most proximal to rear side 114 of cabinet 102). Rear freezer wall 228 may further be positioned opposite an opening defined between the transverse freezer walls 220, 222, 224, 226 and selectively covered by door 130.

When assembled, internal liner 120 may be assembled at least partially within outer liner 118 (FIG. 1). Insulation (not pictured) may be positioned between internal liner 120 and outer liner 118 along outer surface 208. Additionally or alternatively, insulation may be positioned along outer surface 208 between fresh food chamber 122 and freezer chamber 124.

Figure 7:
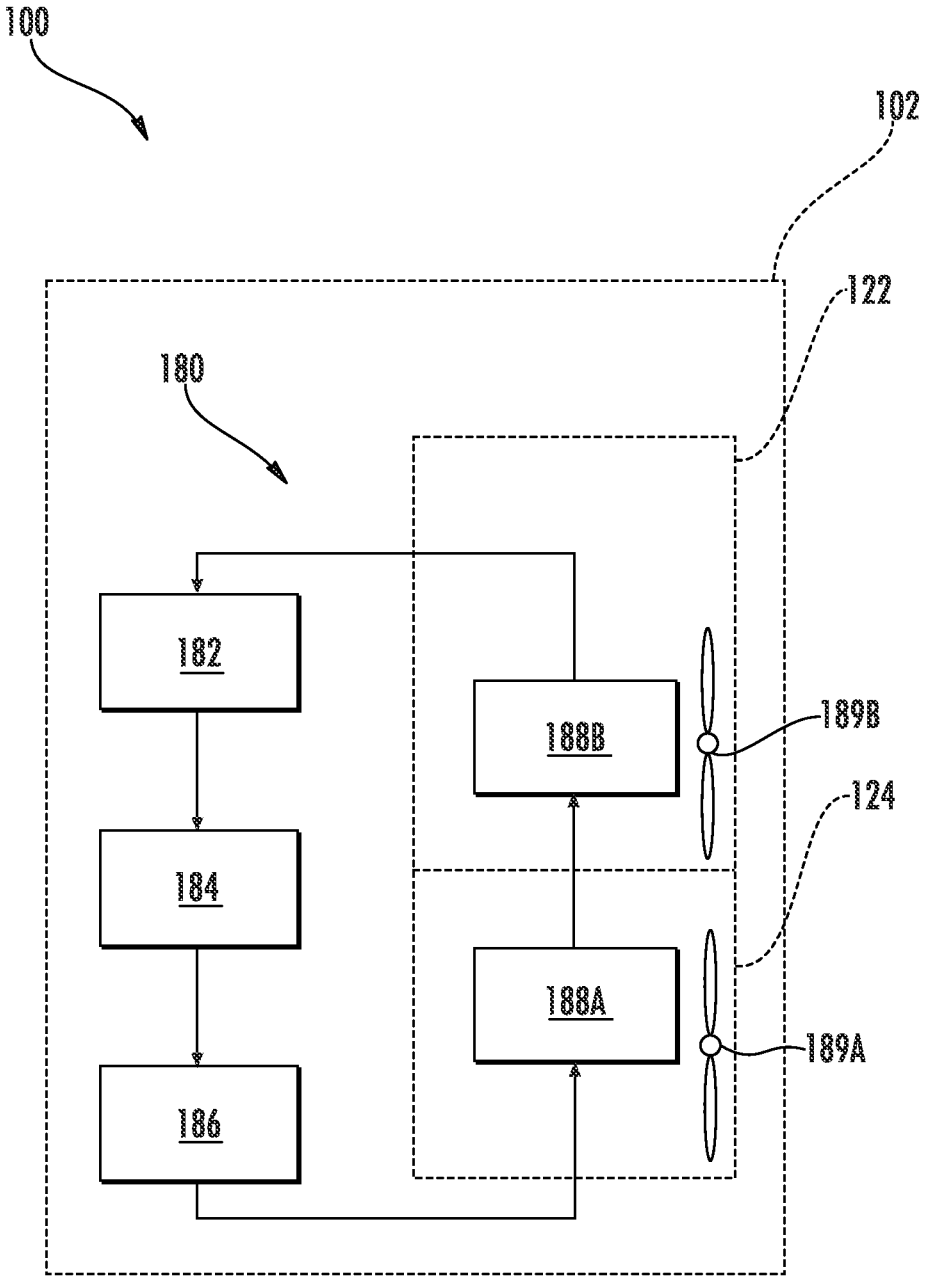
FIG. 7 provides a schematic view of a refrigerator appliance, including a sealed cooling system, according to example embodiments of the present disclosure.

Turning briefly to FIG. 7, a schematic view of certain components of a sealed cooling system 180 for refrigerator appliance 100 is provided. As may be seen in FIG. 7, refrigerator appliance 100 includes a sealed cooling system 180 for executing a vapor compression cycle for cooling air within refrigerator appliance 100, e.g., within fresh food chamber 122 and freezer chamber 124. Sealed cooling system 180 includes a compressor 182, a condenser 184, an expansion device 186, and one or more evaporators 188A, 188B connected in fluid series and charged with a refrigerant. As will be understood by those skilled in the art, sealed cooling system 180 may include additional or fewer components. For example, sealed cooling system 180 may include only a single evaporator (e.g., mounted within fresh food chamber 122 or freezer chamber 124) or multiple discrete evaporators positioned separate locations within cabinet 102.

Within sealed cooling system 180, gaseous refrigerant flows into compressor 182, which operates to increase the pressure of the refrigerant. This compression of the refrigerant raises its temperature, which is lowered by passing the gaseous refrigerant through condenser 184. Within condenser 184, heat exchange (e.g., with ambient air) takes place so as to cool the refrigerant and cause the refrigerant to condense to a liquid state.

Expansion device 186 (e.g., a valve, capillary tube, or other restriction device) receives liquid refrigerant from condenser 184. From expansion device 186, the liquid refrigerant enters evaporator 188A and/or evaporator 188B. In some embodiments, such as the embodiment of FIG. 7, one evaporator 188A is positioned within freezer chamber 124 while another evaporator 188B is positioned within fresh food chamber 122. Upon exiting expansion device 186 and entering evaporator(s) 188A, 188B, the liquid refrigerant drops in pressure and vaporizes. Due to the pressure drop and phase change of the refrigerant, evaporators 188A, 188B are cool relative to freezer and fresh food chambers 124 and 122 of refrigerator appliance 100. As such, cooled air is produced and refrigerates freezer and fresh food chambers 124 and 122 of refrigerator appliance 100. Thus, evaporators 188A, 188B are heat exchangers which transfer heat from air passing over evaporators 188A, 188B to refrigerant flowing through evaporators 188A, 188B. In some embodiments, an air handler 189A or 189B, such as a fan or blower, is provided adjacent to one or more of evaporators 188A, 188B. For instance, air handler 189A may be provided within freezer chamber 124 to motivate air across evaporator 188A. Additionally or alternatively, air handler 189B may be provided within fresh food chamber 122 to motivate air across evaporator 188B.

Figure 8:
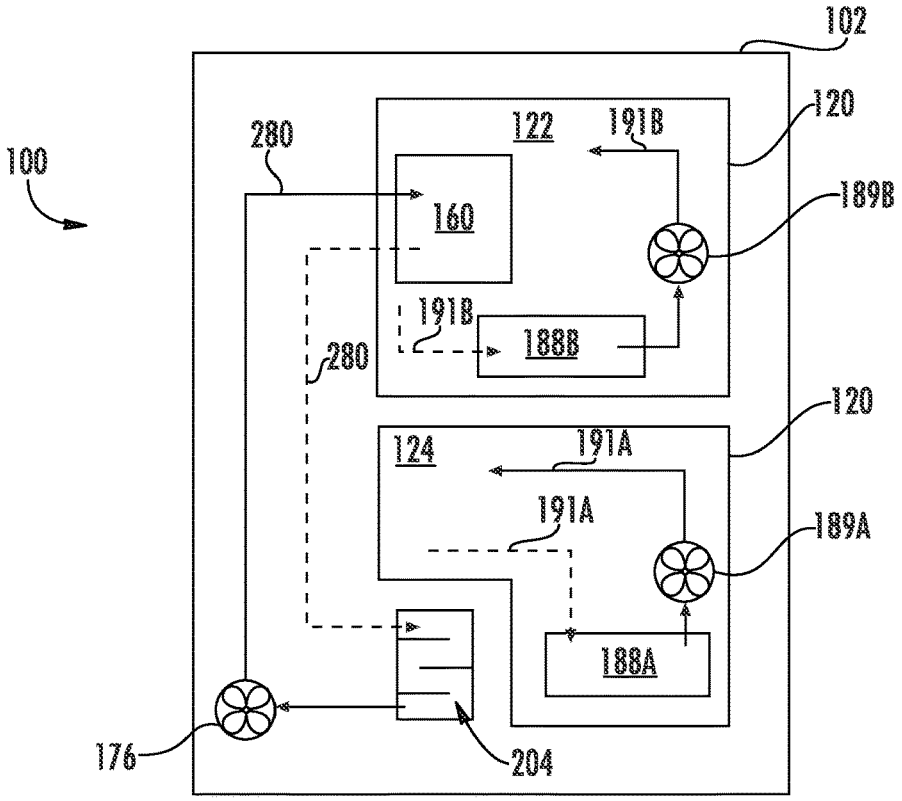
FIG. 8 provides a schematic view of a refrigerator appliance according to example embodiments of the present disclosure.
Figure 9:
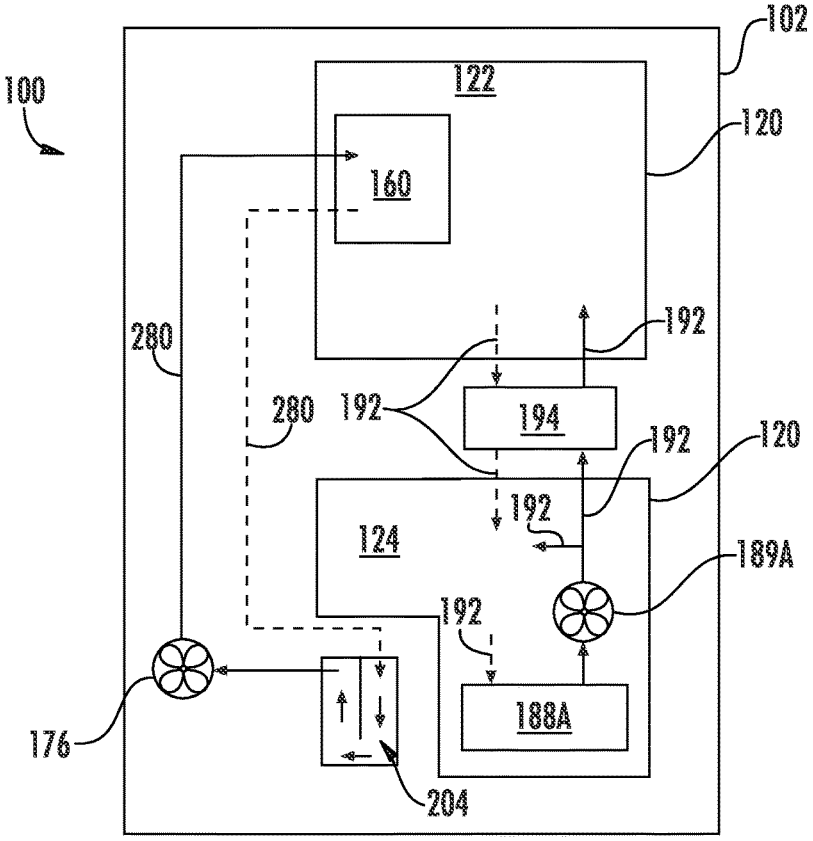
FIG. 9 provides a schematic view of a refrigerator appliance according to example embodiments of the present disclosure.

Turning briefly now to FIGS. 8 and 9, schematic views of certain embodiments of refrigerator appliance 100 are illustrated. Optionally, as shown in FIG. 8, refrigerator appliance 100 may provide freezer chamber 124 in fluid isolation from fresh food chamber 122, e.g., when doors 128 and 130 are in a closed position (FIG. 1). Alternatively, as shown in FIG.

9, refrigerator appliance 100 may provide freezer chamber 124 in fluid communication with fresh food chamber 122, e.g., when doors 128 and 130 are in a closed position (FIG. 1).

As may be seen in FIG. 8, internal liner 120 may define a fluidly isolated freezer chamber 124 and fresh food chamber 122. During operations, air handler 189A may be activated (e.g., rotated as commanded by controller 190-FIG. 1), thereby motivating a freezer airflow (represented by arrows 191A) within a portion of freezer chamber 124. Specifically, the airflow 191A may flow across at least a portion of evaporator 188A, thereby furthering convection heat transfer within freezer chamber 124. Separately or independently, air handler 189B may be activated (e.g., rotated as commanded by controller 190), thereby motivating a fresh food airflow (represented by arrows 191B) within a portion of fresh food chamber 122. Specifically, the airflow 191B may flow across at least a portion of evaporator 188B, thereby furthering convection heat transfer within fresh food chamber 122. Airflows 191A, 191B will thus recirculate apart from each other. As will be described below, another separate airflow (represented by arrows 280) may be selectively motivated (e.g., by air handler 176) between icebox compartment 160 and convection compartment 204.

As may be seen in FIG. 9, internal liner 120 may define a fluidly communicating freezer chamber 124 and fresh food chamber 122. During operations, air handler 189A may be activated (e.g., rotated as commanded by controller 190-FIG. 1), thereby motivating a dual-chamber airflow (represented by arrows 192) within a portion of freezer chamber 124. Specifically, the airflow 192 may flow across at least a portion of evaporator 188A, thereby furthering convection heat transfer within freezer chamber 124. Moreover, the airflow 192 may further be directed to a portion of fresh food chamber 122. Specifically, the airflow 192 may be selectively permitted or restricted through a flow control device 194 (e.g., air damper or valve) in fluid communication between freezer chamber 124 and fresh food chamber 122. Optionally, at least a portion of the airflow 192 may be circulated within freezer chamber 124 without passing to fresh food chamber 122. Additionally or alternatively, flow control device 194 may be selectively opened and closed (e.g., as commanded by controller 190) based on cooling demands within freezer chamber 124 and fresh food chamber 122. The airflow 192 may thus be selectively circulated from freezer chamber 124 to fresh food chamber 122 and vice versa. As will be described below, another separate airflow (e.g., represented by arrows 280) may be selectively motivated (e.g., by air handler 176) between icebox compartment 160 and convection compartment 204.

Returning to FIGS. 3 through 6, a heat exchange case 202 is provided on a portion of internal liner 120. Specifically, heat exchange case 202 is positioned or mounted along a portion of internal liner 120 at the freezer chamber 124. When assembled, heat exchange case 202 at least partially defines a convection compartment 204. As shown, the internal liner 120 (e.g., the portion of internal liner 120 along which heat exchange case 202 is positioned) may further define convection compartment 204. In some such embodiments, heat exchange case 202 is positioned within or enclosed by freezer chamber 124. In turn, a portion of inner surface 206 defines convection compartment 204 with heat exchange case 202.

Generally, convection compartment 204 is provided in fluid isolation from freezer chamber 124. In other words, air may not be readily exchanged between convection compartment 204 and freezer chamber 124 (e.g., the surrounding portion of freezer chamber 124). For instance, heat exchange case 202 may be provided as a solid member lacking any door or open passage in fluid communication with freezer chamber 124 and/or fresh food chamber 122. Nonetheless, heat exchange case 202 may be conductive thermal communication with internal liner 120 at freezer chamber 124. Although convection compartment 204 is illustrated as a generally open cavity in FIGS. 3 through 6, alternative embodiments may include one or more fin members (e.g., attached to or formed on heat exchange case 202 and/or internal liner 120) extending into convection compartment 204, thereby increasing the surface area within convection compartment 204.

During use, heat may transfer between convection compartment 204 and freezer chamber 124 during operations of appliance 100, e.g., through internal liner 120. Specifically, heat may be conducted from convection compartment 204 and through internal liner 120 before being absorbed within the relatively cool environment of freezer chamber 124. In turn, convection may further serve to draw heat from the affected portions of internal liner 120. In some embodiments, heat may additionally be conducted from convection compartment 204 through heat exchange case 202 and absorbed within freezer chamber 124. Optionally, an evaporator (e.g., evaporator 188A) may be mounted adjacent to heat exchange case 202 outside of convection compartment 204 to further promote heat transfer from convection compartment 204. Advantageously, the sealed convection compartment 204 may prevent or reduce significant temperature variations or gradients within freezer chamber 124 without requiring additional active cooling components, such as an evaporator, within the convection compartment 204.

In turn, convection compartment 204 may be an evaporator-free compartment. Specifically, no evaporator (or other isolated refrigerant-flowing component, such as a condenser) of a sealed or unsealed refrigeration system is provided within convection compartment 204. Icebox compartment 160 and/or air passages 242, 252 may further be evaporator-free such that the air path defined through air circulation system 200 does not include any evaporator or otherwise active refrigeration component. In turn, air flowed between convection compartment 204 and icebox compartment 160 may be recirculated without directly flowing over or across an evaporator or other isolated refrigerant-flowing component. Advantageously, assembly and operation of air circulation system 200 may be relatively easy, quick, and cost effective while providing efficient and effective cooling therethrough.

In some embodiments, an air handler 176 is provided in fluid communication between convection compartment 204 and icebox compartment 160 to motivate air between icebox compartment 176 and convection compartment 204. Air handler 176 may be operably coupled (e.g., electrically coupled) to controller 190 (FIG. 1). In turn, controller 190 may be configured to activate or otherwise operate air handler 176 as desired. In optional embodiments, the performance of air handler 176 (e.g., the speed of rotation or volumetric flow rate at which air handler 176 motivates air therethrough) is operatively linked to operation of icemaker 152. For instance, the rate at which icemaker 152 produces ice (e.g., mass of ice produced per day) may correspond to performance of air handler 176. Either component 176 or 154 may be a variable component. In some such embodiments, the ice production rate of icemaker 152 may be selectively varied according to the performance of air handler 176. As an example, icemaker 152 may produce a relatively high mass of ice per day when air handler 176 operates at a first speed and another relatively low mass of ice per day when air handler operates at a second speed that is lower than the first speed.

Although convection compartment 204 generally provides an open void through which air may flow, convection compartment 204 may be defined as a non-linear airflow path. For instance, at least a portion of the convection compartment 204 within heat exchange case 202 between return outlet 256 and supply inlet 244 may be non-linear such that air 280 passing therethrough is redirected one or more times. In some such embodiments, one or more air-guiding components may be included. For instance, a partition wall 230 may extend within convection compartment 204 at a position between the heat exchange case 202 and the portion of the internal liner 120 defining convection compartment 204. In certain embodiments, partition wall 230 extends downward along the vertical direction V from a top portion of convection compartment 204. Partition wall 230 may thus separate convection compartment 204 into a forward cavity 232 and a rearward cavity 234. A flow channel 236 may be defined between forward cavity 232 and rearward cavity 234, e.g., as a vertical gap between partition wall 230 and a bottom portion of convection compartment 204.

In additional or alternative embodiments, an air handler 176 may be provided within convection compartment 204. For instance, air handler 176 may be mounted on partition wall 230 and/or against a portion of internal liner 120. Advantageously, such mounting may advantageously absorb or reduce vibrations and noise generated by air handler 176 during operations. Nonetheless, alternative embodiments may include air handler at another suitable position that is outside of the convection chamber 204, but otherwise in fluid communication therewith.

As shown, convection compartment 204 may be generally provided in fluid communication with icebox compartment 160. Specifically, a separate air supply duct 166 and air return duct 168 are provided in fluid communication between convection compartment 204 and icebox compartment 160. Air supply duct 166 defines a supply passage 242 that extends vertically between a supply inlet 244 and a supply outlet 246. When assembled, the supply outlet 246 is positioned above supply inlet 244, e.g., proximal to icebox liner 132. Air return duct 168 defines a return passage 252 that extends vertically between a return inlet 254 and a return outlet 256. When assembled, return inlet 254 is positioned above return outlet 256, e.g., proximal icebox liner 132. Optionally, return inlet 254 may be further positioned below supply outlet 246. Additionally or alternatively, return outlet 256 and supply inlet 244 may be defined at the convection compartment 204 forward from the rear freezer wall 228 along the transverse direction T.

In order to exchange air with ducts 166, 168, icebox liner 132 defines an icebox inlet 248 in downstream communication with supply outlet 246, as well as a separate icebox outlet in upstream communication with return inlet 254. In some embodiments, one or more gaskets 260 may be provided between icebox inlet 248 and supply outlet 246, as well as between icebox outlet 258 and return inlet 254. In other words, gasket(s) 260 may be provided at a mating surface of icebox liner 132 and internal liner 120 to sealingly engage the other. For instance, when the door 128 is in a closed position, a gasket 260 may sealingly engage a first fresh food sidewall 210 with icebox liner 132 to prevent air leakage. In turn, gaskets 260 may help to prevent or minimize cold air flowing between supply duct 166 and return duct 168 from escaping into the fresh food chamber 122 and/or relatively warm, humid air from fresh food chamber 122 from entering return duct 168.

During operations, and when door 128 is in the closed position, air may be directly recirculated between icebox compartment 160 and convection compartment 204 (as indicated by arrows 280). For instance, air handler 176 may motivate relatively low-temperature air from the rearward cavity 234 of convection compartment 204 into air supply duct 166 through supply inlet 244. Air within supply duct 166 may travel through supply passage 242 before flowing directly from supply outlet 246 to icebox inlet 248 and into icebox compartment 160. Within icebox compartment 160, air may then flow, e.g., downward along the vertical direction V, across icemaker 152 and storage bin 154. Thus, air may absorb heat within icebox compartment 160, e.g., through convection, before flowing through icebox outlet 258 and return inlet 254 below storage bin 154. Air may subsequently flow through return passage 252 before flowing through convection compartment 204. Within convection compartment 204, air may flow successively through forward cavity 232 and flow channel 236 before returning to rearward cavity 234.

Over time, or in response to extended cooling operations, frost may form on certain portions of heat exchange case 202 and/or within convection compartment 204. In some embodiments, a defrost heater 270 may be utilized to defrost convection compartment 204, e.g., to melt ice that accumulates on heat exchange case 202 and/or within convection compartment 204. Defrost heater 270 may be any suitable heater, such as an electrical resistive heater, radiant heater, etc. Moreover, defrost heater 270 may be positioned adjacent or in close proximity to (e.g., below) convection compartment 204 within or adjacent freezer chamber 124. In certain modes of operation, defrost heater 270 may be activated periodically; that is, a period of time tice elapses between when defrost heater 270 is deactivated and when defrost heater 270 is reactivated to melt a new accumulation of ice at convection compartment 204. The period of time tice may be a preprogrammed period such that time tice is the same between each period of activation of defrost heater 270, or the period of time may vary. Additionally or alternatively, in certain modes of operation defrost heater 270 may be activated based on some other condition, such as the temperature of convection compartment 204 or any other appropriate condition.

In some embodiments, a defrost termination thermostat 272 may be used to monitor the temperature of convection compartment 204 such that defrost heater 270 is deactivated when thermostat 272 measures that the temperature of convection compartment 204 is above a set temperature, i.e., greater than thirty-two degrees Fahrenheit (32° F.). In some embodiments, thermostat 272 may send a signal to controller 190 (FIG. 1) or other suitable device to deactivate defrost heater 270 when convection compartment 204 is above the set temperature. In other embodiments, defrost termination thermostat 272 may comprise a switch such that defrost heater 270 is switched off when thermostat 272 measures that the temperature of convection compartment 204 is above the set temperature.

In certain embodiments, a drain line 274 is disposed below heat exchange case 202. For instance, drain line 274 may be positioned adjacent heat exchange case 202 and be configured for directing liquid from, for example, an outer portion of heat exchange case 202. Optionally, an evaporator pan 276 may be positioned within cabinet 102. In some such embodiments, drain line 274 extends between and fluidly connects an outer portion of heat exchange case 202 and evaporator pan 276. In particular, drain line 274 directs liquid runoff from heat exchange case 202 to evaporator pan 276, e.g., during a defrost cycle of defrost heater 270. Within evaporator pan 276, such liquid can evaporate.

As will be understood by those skilled in the art, evaporator pan 276 can also receive liquid runoff from one or more of the evaporator(s) of refrigerator appliance 100, e.g., during another defrost cycle of refrigerator appliance 100. However, in alternative exemplary embodiments, evaporator pan 276 can be a separate component such that runoff from heat exchange case 202 and the evaporator(s) of refrigerator appliance 100 are directed to separate pans. In additional or alternative embodiments, drain line 274 can be directed to a drain of a plumbing system (not shown), e.g., within a residence housing refrigerator appliance 100, such that run off is directed into the plumbing system rather than evaporating within refrigerator appliance 100.

Figure 10:
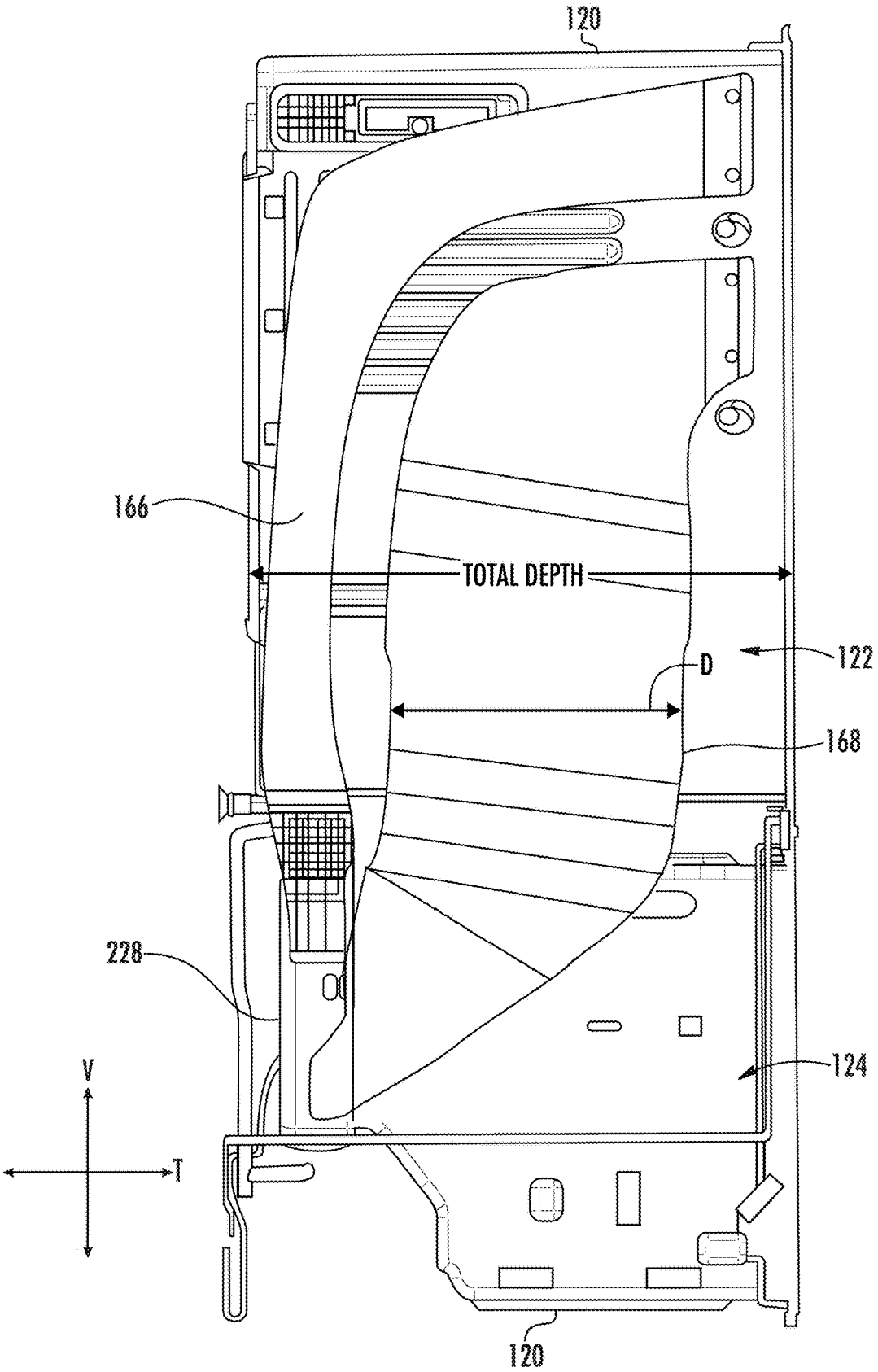
FIG. 10 provides a side view of an internal liner and air circulation system of a refrigerator appliance according to example embodiments of the present disclosure.
Figure 11:
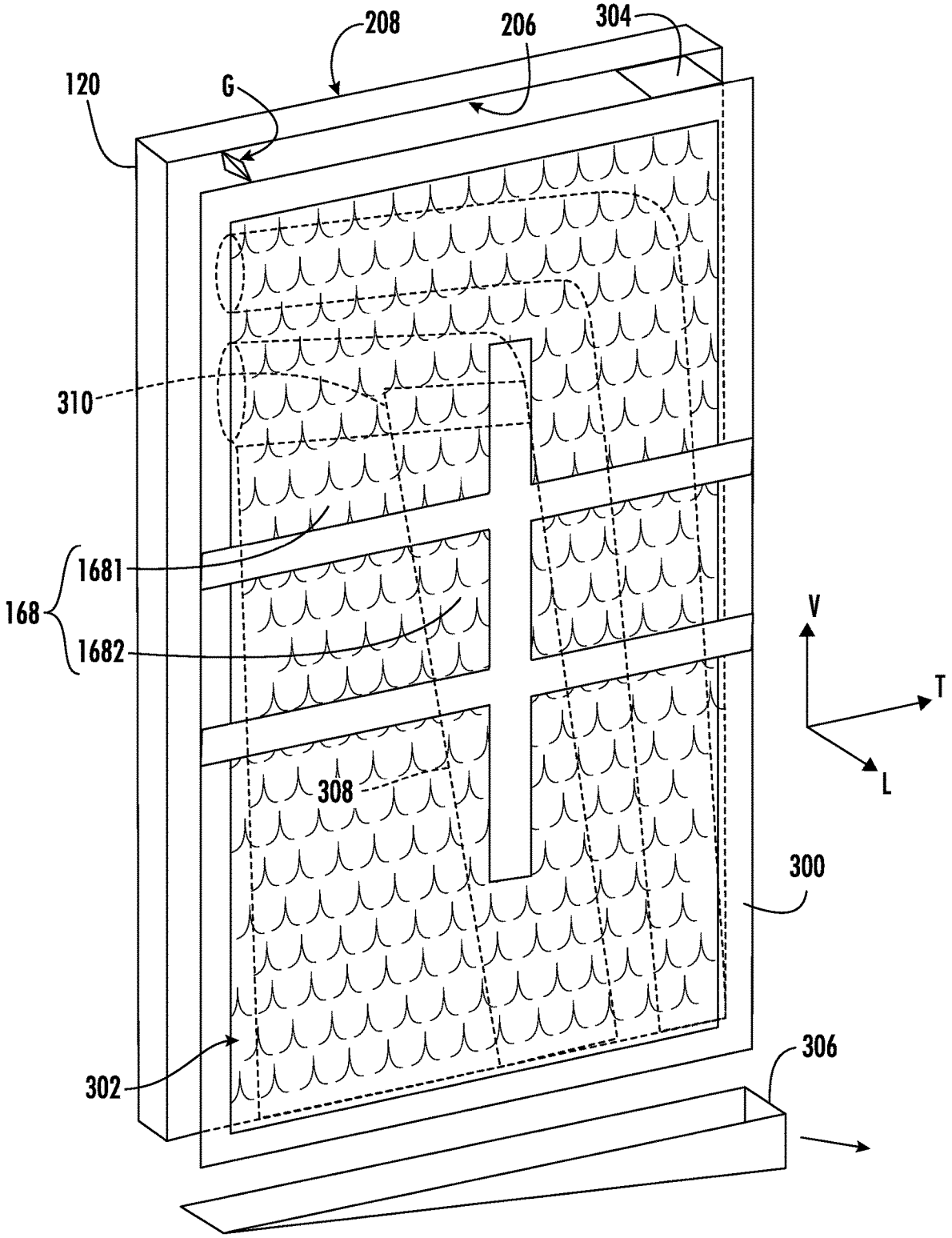
FIG. 11 is a perspective schematic view of a sidewall of the internal liner of FIG. 10 including a separate panel according to exemplary embodiments of the present disclosure.

Turning briefly to FIGS. 10 and 11, additional or alternative example embodiments of refrigerator appliance 100 including an internal liner 120 and an alternative embodiment of air circulation system 200 are shown. Except as otherwise indicated, it is understood that the embodiments of FIGS. 10 and 11 are substantially similar to the embodiments described above with respect to FIGS. 1 through 9. In turn, the same numerals are generally used throughout. Moreover, it is also understood that the embodiments of FIGS. 10 and 11 could be modified to include features of the embodiments of FIGS. 1 through 9, and vice versa, except as otherwise indicated.

As shown, some embodiments of internal liner 120 may hold heat exchange case 202 at a rear portion thereof. For instance, heat exchange case 202 may be attached to internal liner 120 adjacent to evaporator 188A within a portion of freezer chamber 124. In specific embodiments, heat exchange case 202 and evaporator 188A may be housed between an evaporator cover 196 of internal liner 120 and another portion of internal liner 120 (e.g., rear wall 228). Optionally, evaporator cover 196 may substantially enclose heat exchange case 202 and evaporator 188A separate from the rest of freezer chamber 124, while still permitting fluid communication therebetween. Additionally or alternatively, a portion of evaporator cover 196 may further define a portion of convection compartment 204 with heat exchange case 202, while another portion of evaporator cover 196 extends outside of convection compartment 204 (e.g., across evaporator 188A). Heat within convection compartment 204 may thus be advantageously conducted away from heat exchange case 202 and outside of convection compartment 204.

In some embodiments, air handler 189A is provided to circulate air within freezer chamber 124. For instance, air handler 189A may be mounted on evaporator cover 196 to motivate air across evaporator 188A and/or heat exchange case 202 (e.g., outside of and separate from convection compartment 204). In certain embodiments, a diverter plate may be mounted adjacent to air handler 189A to guide airflow therefrom. Specifically, the diverter plate may guide airflow in the direction of heat exchange case 202. Air handler 189A may thus operate to direct a freezer airflow toward convection compartment 204 (e.g., without passing any air into convection compartment). Convective heat exchange with convection compartment 204 may thus be advantageously promoted or accelerated without exchanging any air between freezer chamber 204 and convection compartment 204.

As mentioned above, air supply duct 166 and air return duct 168 may be provided between outer liner 118 and inner liner 120. Air may be selectively supplied from evaporator (e.g., freezer chamber evaporator) 188A to icebox compartment 160 (or icemaker 152). According to some embodiments, air return duct 168 may be enlarged (e.g., along the transverse direction T). For instance, air return duct 168 may define a width W along lateral direction L and a depth D along the transverse direction T. A ratio of the depth D to the width W of the air return duct 168 may be between about 8:1 and about 12:1. Thus, air return duct 168 may be elongated along the transverse direction T. According to some embodiments, the depth D of air return duct 168 is between about 30% and about 60% of a total depth T of appliance 100. In some instances, the depth D of air return duct 168 is an average depth of air return duct 168 along the vertical direction V. Accordingly, air return duct 168 may have a relatively large surface area along the transverse direction T and the vertical direction V (e.g., adjacent to inner liner 120). Additionally or alternatively, a total airflow cross-section of air return duct 168 may be greater than a total airflow cross-section of air supply duct 166.

Referring briefly to FIG. 6, air return duct 168 may be positioned directly adjacent to inner liner 120. In detail, air return duct 168 may be in planar contact with outer surface 208 of inner liner 120 (e.g., outside of fresh food compartment 122). For instance, no gap is provided between air return duct 168 and inner liner 120. Additionally or alternatively, no insulation is provided between air return duct 168 and inner liner 120. The side panel of inner liner 120 adjacent air return duct 168 may thus be referred to as a "cold wall." Advantageously, the cool air flowing through air return duct 168 may remove heat from fresh food chamber 122, producing a cooling effect to air within fresh food compartment. Additionally or alternatively, air supply duct 166 may be in planar contact with outer surface 208 of inner liner 120 (e.g., adjacent to air return duct 168).

Referring now to FIG. 11, refrigerator appliance 100 may include a panel 300. Panel 300 may be positioned within fresh food chamber 122. For instance, panel 300 may be provided adjacent to inner surface 206 of inner liner 120. Additionally or alternatively, panel 300 may be positioned at or near a location of air return duct 168 (and/or air supply duct 166). For instance, panel 300 may be positioned at inner liner 120 opposite air return duct 168 along the lateral direction L. Advantageously, inner surface 206 of inner liner 120 may be visually blocked or hidden by panel 300. Accordingly, panel 300 may be a decorative panel. Further, panel 300 may be spaced apart from inner surface 206 of inner liner 120. For instance, a gap G may be formed between inner liner 120 and panel 300. Gap G may have any suitable width such that an air flow is permitted therethrough between panel 300 and inner liner 120.

Panel 300 may include a light assembly 302. Light assembly 302 may include any suitable number, type, position, and configuration of electrical light source(s), using any suitable light technology and illuminating in any suitable color. For example, according to the illustrated embodiment, light assembly 302 includes one or more light emitting diodes (LEDs), which may each illuminate in a single color (e.g., white LEDs), or which may each illuminate in multiple colors (e.g., multi-color or RGB LEDs) depending on the control signal from controller 190. However, it should be appreciated that according to alternative embodiments, light assembly 302 may include any other suitable traditional light bulbs or sources, such as halogen bulbs, fluorescent bulbs, incandescent bulbs, glow bars, a fiber light source, etc.

For one example, light assembly 302 is arranged according to a predetermined pattern along a face (e.g., lateral face) of panel 300. For instance, light assembly 302 may be arranged according to a grid pattern. Each or a select number of the plurality of LEDs may be selectively illuminated according to inputs from controller 190. For one example, the plurality of LEDs is configured to illuminate upon an opening of door 128. Additionally or alternatively, light assembly 302 may be configured to illuminate according to a predetermined schedule. The predetermined schedule may be based on an activation of an evaporator (e.g., freezer chamber evaporator 188A or fresh food chamber evaporator 188B). For another example, moisture may develop along inner surface 206 of inner liner 120 (e.g., within gap G). Advantageously, the moisture may be hidden by panel 300. Additionally or alternatively, the activation of light assembly 302 may assist in promoting evaporation of the moisture within gap G. As would be understood, two mor more panels 300 may be provided (e.g., one on each lateral side wall and along the rear wall of fresh food chamber 122).

Refrigerator appliance 100 may include an air handler 304. Air handler 304 may be in fluid communication with gap G between inner liner 120 and panel 300. For instance, air handler 304 may be configured to motivate, urge, or otherwise blow air through gap G and into fresh food chamber 122. Air handler 304 may be an axial fan positioned within gap G. However, it should be appreciated that according to alternative embodiments, air handler 304 may be positioned at any other suitable location and may be any other suitable fan type, such as a tangential fan, a centrifugal fan, etc.

In addition, according to an exemplary embodiment, air handler 304 is a variable speed fan such that it may rotate at different rotational speeds, thereby generating different air flow rates. In this manner, the amount of cool air drawn from gap G may be continuously and precisely regulated. Moreover, by pulsing the operation of air handler 304 or throttling air handler 304 between different rotational speeds, the flow of cool air drawn into fresh food chamber 122 may enter from a different direction, may have a different flow velocity, or may generate a different flow pattern within fresh food chamber 122. Thus, by pulsating the variable speed fan or otherwise varying its speed, the flow of cool air may be randomized, thereby eliminating stagnant regions within fresh food chamber 122 and better circulating the flow of cool air to provide a more even cooling profile.

Refrigerator appliance 100 may include a drip tray 306. Drip tray 306 may be in fluid communication with gap G. For instance, drip tray 306 may be positioned beneath gap G along the vertical direction V. As mentioned above, due to a temperature difference between air return duct 168 and gap G (e.g., within fresh food chamber 122), moisture may form along inner surface 206 of inner liner 120 (e.g., within gap G). Thus, the moisture may flow downward along the vertical direction V and be collected within drip tray 306.

Drip tray 306 may be fluidly connected with a drain. For instance, in an instance where refrigerator appliance 100 is a plumbed appliance, the moisture collected within drip tray 306 may flow toward a connected drain to be removed from refrigerator appliance. Additionally or alternatively, drip tray 306 may be fluidly connected with evaporator pan 276. Thus, the moisture collected within drip tray 306 may be transferred to evaporator pan 276 to either evaporate or otherwise be expelled from refrigerator appliance 100 (e.g., via a drain).

According to some embodiments, air return duct 168 may be split into a first flow path 1681 and a second flow path 1682. For instance, with reference to FIG. 11, a wall 308 may be provided within air return duct 168. Wall 308 may extend predominantly along the vertical direction V and the transverse direction T to form first flow path 1681 and second flow path 1682. One or more dampers 310 may be provided within air return duct 168. For instance, one damper 310 is positioned at or near return inlet 254. Damper 310 may be selectively moved to optionally close either first flow path 1681 or second flow path 1682. Additionally or alternatively, damper 310 may be positioned such that each of first flow path 1681 and second flow path 1682 is open. Accordingly, the air flowing through air return duct 168 may be adjusted according to a desired temperature of fresh food chamber 122. For instance, to avoid overcooling of fresh food chamber 122, either first flow path 1681 or second flow path 1682 may be closed off to limit the amount of cool air flowing through air return duct 168.

According to the embodiments described above, a refrigerator appliance may include an air supply duct and an air return duct. The air return duct may be elongated along the transverse direction, or parallel with a side member of the appliance. The air return duct may thus have a relatively large surface area in contact with a liner of the appliance. Cold air within the air return duct may remove heat from a fresh food chamber of the appliance, for instance, during an ice making operation within a built-in icemaker of the appliance. A panel may be provided adjacent to the side member and within the fresh food chamber. The panel may be a decorative panel. The panel may include a light assembly. Moisture within a gap between the panel and the side member may be collected and removed from the fresh food compartment. Advantageously, a single evaporator may be used within the appliance, eliminating the need for a second (e.g., fresh food chamber) evaporator and thus increasing a volume of the fresh food chamber.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a cabinet;

a liner attached to the cabinet and defining a fresh food chamber and a freezer chamber; wherein a receiving space is formed between the cabinet and the liner;

an icemaker at least partially received within the fresh food chamber;

a cooling system comprising:

an air supply duct in fluid communication with the icemaker and positioned within the receiving space;

an air return duct in fluid communication with the icemaker and positioned within the receiving space; and a fan configured to motivate air through the air supply duct and the air return duct, wherein the air return duct is in planar contact with an outer surface of the liner along the fresh food chamber forming a cold wall; and a panel positioned within the fresh food chamber and adjacent to the liner opposite the air supply duct and the air return duct, wherein a gap is formed between the liner and the panel.

2. The refrigerator appliance of claim 1, wherein an airflow cross-section of the air return duct is greater than an airflow cross-section of the air supply duct.

3. The refrigerator appliance of claim 1, wherein a depth of the air return duct parallel to the panel is between 30% and 60% of a total depth of the panel.

4. The refrigerator appliance of claim 1, wherein a ratio of a depth of the air return duct parallel to the panel to a width of the air return duct perpendicular to the panel is between 8:1 and 12:1.

5. The refrigerator appliance of claim 1, further comprising:

an air handler in fluid communication with the gap formed between the liner and the panel, the air handler configured to motivate air through the gap and into the fresh food chamber.

6. The refrigerator appliance of claim 1, further comprising:

a drip tray in fluid communication with the gap, the drip tray configured to collect condensate produced within the gap.

7. The refrigerator appliance of claim 1, wherein the panel comprises a plurality of light emitting diodes (LEDs).

8. The refrigerator appliance of claim 1, further comprising:

a door movably coupled to the cabinet, the door providing selective access to the fresh food chamber, wherein the icemaker is positioned within the door.

9. The refrigerator appliance of claim 1, wherein the cooling system further comprises:

an evaporator positioned adjacent to the freezing chamber, the evaporator being in fluid communication with each of the freezing chamber, the air supply duct, and the air return duct.

10. The refrigerator appliance of claim 9, wherein the air return duct comprises:

a first flow path between the evaporator and the icemaker;

a second flow path between the evaporator and the icemaker, the second flow path being fluidly parallel with the first flow path; and a damper to selectively open at least one of the first flow path or the second flow path.

11. A refrigerator appliance defining a vertical direction, a lateral direction, and a transverse direction, the refrigerator appliance comprising:

a cabinet;

a liner attached to the cabinet and defining a fresh food chamber and a freezer chamber; wherein a receiving space is formed between the cabinet and the liner;

an icemaker at least partially received within the fresh food chamber;

a cooling system comprising:

an air supply duct in fluid communication with the icemaker and positioned within the receiving space along a first lateral side of the fresh food chamber;

an air return duct in fluid communication with the icemaker and positioned within the receiving space along the first lateral side of the fresh food chamber;

an evaporator positioned at the freezer chamber; and a fan configured to motivate air from the evaporator through the air supply duct and the air return duct, wherein the air return duct is in planar contact with an outer surface of the liner along the first lateral side of the fresh food chamber forming a cold wall; and a panel positioned within the fresh food chamber and adjacent to the liner opposite the air supply duct and the air return duct, wherein a gap is formed between the liner and the panel.

12. The refrigerator appliance of claim 11, wherein an airflow cross-section of the air return duct is greater than an airflow cross-section of the air supply duct.

13. The refrigerator appliance of claim 11, wherein a depth of the air return duct along the transverse direction is between 30% and 60% of a total depth of the panel along the lateral direction.

14. The refrigerator appliance of claim 11, wherein a ratio of a depth of the air return duct along the transverse direction to a width of the air return duct along the lateral direction is between 8:1 and 12:1.

15. The refrigerator appliance of claim 11, further comprising:

an air handler in fluid communication with the gap formed between the liner and the panel, the air handler configured to motivate air through the gap and into the fresh food chamber.

16. The refrigerator appliance of claim 11, further comprising:

a drip tray in fluid communication with the gap, the drip tray configured to collect condensate produced within the gap.

17. The refrigerator appliance of claim 11, wherein the panel comprises a plurality of light emitting diodes (LEDs).

18. The refrigerator appliance of claim 11, further comprising:

a door movably coupled to the cabinet, the door providing selective access to the fresh food chamber, wherein the icemaker is positioned within the door.

19. The refrigerator appliance of claim 11, wherein the evaporator is in fluid communication with each of the freezing chamber, the air supply duct, and the air return duct.

20. The refrigerator appliance of claim 19, wherein the air return duct comprises:

a first flow path between the evaporator and the icemaker;

a second flow path between the evaporator and the icemaker, the second flow path being fluidly parallel with the first flow path; and a damper to selectively open at least one of the first flow path or the second flow path.

* * * * *